US009516933B2

(12) United States Patent
Woodall et al.

(10) Patent No.: US 9,516,933 B2
(45) Date of Patent: Dec. 13, 2016

(54) SHOCK ABSORBER CANE SYSTEMS

(71) Applicants: Charlene E. Woodall, Show Low, AZ (US); Joseph Lumia, Show Low, AZ (US)

(72) Inventors: Charlene E. Woodall, Show Low, AZ (US); Joseph Lumia, Show Low, AZ (US)

( * ) Notice: Subject to any disclaimer, the term of this patent is extended or adjusted under 35 U.S.C. 154(b) by 0 days.

(21) Appl. No.: 14/662,148

(22) Filed: Mar. 18, 2015

(65) Prior Publication Data

US 2016/0058140 A1 Mar. 3, 2016

Related U.S. Application Data

(63) Continuation-in-part of application No. 14/475,053, filed on Sep. 2, 2014, now abandoned.

(51) Int. Cl.

| | |
|---|---|
| ***A45B 9/04*** | (2006.01) |
| ***A45B 9/02*** | (2006.01) |
| *A45B 9/00* | (2006.01) |
| *A45B 7/00* | (2006.01) |

(52) U.S. Cl.

CPC ..... *A45B 9/04* (2013.01); *A45B 7/005* (2013.01); *A45B 9/02* (2013.01); *A45B 2009/007* (2013.01)

(58) Field of Classification Search

CPC .... A45B 9/04; A45B 2009/007; A61H 3/0277
USPC ..... 135/75, 77, 65, 72, 82
See application file for complete search history.

(56) References Cited

U.S. PATENT DOCUMENTS

| | | | | | |
|---|---|---|---|---|---|
| 2,297 | A | | 10/1841 | Ball | |
| 26,829 | A | * | 1/1860 | Bickel | A61H 3/02 135/73 |
| 724,382 | A | * | 3/1903 | Conn | 135/69 |
| 1,061,397 | A | | 5/1913 | Newell | |
| 1,336,844 | A | * | 4/1920 | Klousnitzer | 135/82 |
| 1,548,889 | A | | 8/1925 | King | |
| 2,397,499 | A | | 4/1946 | McGowan | |
| 2,398,534 | A | * | 4/1946 | Klausnitzer et al. | 135/82 |
| 2,528,706 | A | | 11/1950 | Osborn | |
| 2,741,255 | A | * | 4/1956 | Neptune | A61H 3/02 135/72 |
| 2,817,348 | A | | 12/1957 | Holliday, Jr. | |
| 2,888,022 | A | * | 5/1959 | Fanning | 135/82 |
| 3,335,735 | A | * | 8/1967 | Colegrove | A61H 3/02 135/69 |
| 5,433,551 | A | | 7/1995 | Gordon | |
| 5,482,072 | A | * | 1/1996 | Cimino | B25G 1/10 135/72 |
| 5,720,474 | A | * | 2/1998 | Sugiyama | 267/249 |
| 5,775,352 | A | | 7/1998 | Obitts | |
| 5,924,434 | A | | 7/1999 | Cato, III | |
| 5,996,602 | A | * | 12/1999 | Cato, III | A45B 9/00 135/65 |

(Continued)

FOREIGN PATENT DOCUMENTS

| | | | | | |
|---|---|---|---|---|---|
| DE | 19602721 | A1 | * | 7/1997 | A45B 9/00 |
| DE | WO 9726053 | A1 | * | 7/1997 | A45B 9/00 |

(Continued)

*Primary Examiner* — Noah Chandler Hawk

(74) *Attorney, Agent, or Firm* — Lodestar Patents, PLLC; Raymond J.E. Hall

(57) ABSTRACT

A cane system having an adjustable shock absorber, a multi-angle handle, a straight handle, and a knob.

6 Claims, 5 Drawing Sheets

(56) References Cited

U.S. PATENT DOCUMENTS

| | | | | |
|---|---|---|---|---|
| 6,055,998 | A * | 5/2000 | Bader | 135/69 |
| 6,286,529 | B1 | 9/2001 | Olivera | |
| 6,883,530 | B2 | 4/2005 | Kawakami | |
| 7,104,271 | B2 * | 9/2006 | Larson et al. | 135/73 |
| 7,395,829 | B2 * | 7/2008 | Chapman | 135/82 |
| 7,610,926 | B2 | 11/2009 | Adams | |
| 7,896,013 | B2 * | 3/2011 | Lerner | A45B 9/02 135/65 |
| 8,166,990 | B2 | 5/2012 | Daily | |
| 8,479,755 | B2 | 7/2013 | Hung | |
| 8,499,776 | B2 | 8/2013 | Ban | |
| 8,720,458 | B2 * | 5/2014 | Dickerson, II | A61H 3/02 135/68 |
| 8,869,812 | B2 | 10/2014 | Basham | |
| 2003/0227167 | A1 * | 12/2003 | Redor | A63C 11/22 280/819 |
| 2005/0076941 | A1 | 4/2005 | Larson et al. | |
| 2007/0120352 | A1 * | 5/2007 | Panizza | A63C 11/22 280/819 |
| 2010/0282282 | A1 * | 11/2010 | Campbell | A45B 9/02 135/77 |
| 2012/0255589 | A1 * | 10/2012 | Larson | A61H 3/0277 135/72 |
| 2014/0014148 | A1 * | 1/2014 | Halonen | A45B 7/00 135/65 |

FOREIGN PATENT DOCUMENTS

| | | | | |
|---|---|---|---|---|
| DE | 10317829 | B4 * | 8/2005 | |
| FR | 3004962 | A1 * | 10/2014 | A63C 11/22 |
| GB | 2340402 | A * | 2/2000 | A61H 3/02 |
| GB | 2340402 | B * | 2/2003 | |

* cited by examiner

SHOCK ABSORBER CANE SYSTEMS

CROSS-REFERENCE TO RELATED APPLICATION

The present application is a continuation-in-part and is related to and claims priority from application Ser. No. 14/475,053, filed Sep. 2, 2014, entitled "SHOCK ABSORBER CANE", the contents of which are incorporated herein by this reference and are not admitted to be prior art with respect to the present invention by the mention in this cross-reference section.

BACKGROUND

This invention relates to providing a system for improved canes. More particularly this invention relates to providing a system for adjustable shock absorbers in canes. Canes are often used to assist in supporting a person having a weak or injured leg. A shock absorbing system in a cane assists to reduce impact shock transferred through the handle of the cane to the user. However, due to variation in the weight of users what may serve as a perfect shock absorber for one user may be too stiff for another (negating the shock absorbing effect). Likewise, when too loose for another user the shock absorber will "bottom out" and again negate the effect of absorbing shock.

Further, variations in the structure of a user's arm, wrist and hand can cause discomfort in gripping a traditional cane handle. Pressure caused from leaning on the cane handle may cause unnecessary pressure on the wrist and palm of the hand. Therefore a need exists to provide adjustable shock absorbers and more comfortable handles on cane systems.

OBJECTS AND FEATURES OF THE INVENTION

A primary object and feature of the present invention is to provide a system overcoming the above-mentioned problems.

It is a further object and feature of the present invention to provide such a system having an adjustable shock absorber.

Another object and feature of the present invention is to provide such a system permitting adjusting of spring tension.

Yet another object and feature of the present invention is to provide such a system allowing adjustment of height of the cane.

A further primary object and feature of the present invention is to provide a system having a handle capable of gripping at multiple angles of inclination.

A further object and feature of the present invention is to provide such a system having an upright "walking stick" orientation.

It is another object and feature of the present invention to provide such a system having a handle positionable at about the height of a person's elbow.

It is a further object and feature of the present invention o provide such a system with a vertical handle extension above the handle.

Another object and feature of the present invention is to provide such a system with a friction-locked height adjuster.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a cane system, relating to minimizing jarring shock and maximizing comfort of a user during use of a cane, comprising: at least one handle structured and arranged to permit user gripping of the cane; at least one walking-surface contactor structured and arranged to contact a walking surface; at least one continuous height adjuster structured and arranged to adjust the height of the cane continuously from a minimum height to a maximum height; and at least one shock absorber structured and arranged to absorb shock occurring, during use of the cane, between such at least one walking-surface contactor and such at least one handle; wherein such at least one shock absorber comprises at least one force adjuster structured and arranged to adjust a compression force of such at least one shock absorber.

Moreover, it provides such a cane system wherein such at least one continuous height adjuster comprises at least two telescoping tubes. Additionally, it provides such a cane system wherein such at least one continuous height adjuster further comprises at least one friction-lock nut. Also, it provides such a cane system wherein such at least one shock absorber comprises at least one compression spring. In addition, it provides such a cane system wherein such at least one shock absorber further comprises at least one shock compression-distance limiter structured and arranged to limit change in the compression distance of such at least one compression spring between such at least one walking-surface contactor and such at least one handle.

And, it provides such a cane system wherein such at least one force adjuster comprises at least one compression adjuster structured and arranged to adjust the compression of such at least one compression spring while at minimum shock-compression. Further, it provides such a cane system wherein such at least one force adjuster further comprises at least one adjustment limiter structured and arranged to limit adjustment distance.

Even further, it provides such a cane system: wherein such at least one force adjuster comprises at least one adjustment stop structured and arranged to adjustably stop one end of such at least one compression spring; wherein such at least one shock absorber compresses such at least one compression spring between at least one end of one tube of such at least two telescoping tubes and such at least one adjustment stop; wherein such at least one shock compression-distance limiter comprises at least one slot near such at least one end of such one tube, and at least one pin structured and arranged to slide along the length of such at least one slot; wherein such at least one shock compression-distance limiter limits the compression distance to about the length of such at least one slot; wherein such at least one force adjuster alters the maximum distance between such at least one end of such one tube of such at least two telescoping tubes and such at least one adjustment stop; wherein such at least one adjustment limiter comprises at least one adjustment slot, and at least one fastener rod structured and arranged to slide along the length of such at least one adjustment slot; wherein such at least one fastener rod couples with such at least one adjustment stop.

Moreover, it provides such a cane system wherein such at least one handle comprises at least one multi-angle handle structured and arranged to permit user gripping of the cane at multiple angles. Additionally, it provides such a cane system wherein such at least one multi-angle handle comprises at least one curve. Also, it provides such a cane system wherein such at least one multi-angle handle further comprises a vertical orientation from end to end when the cane is longitudinally vertical. In addition, it provides such a cane system wherein such at least one handle further comprises at least one single-angle vertical handle structured and arranged to permit gripping of the cane at a single angle, vertical when the cane is longitudinally vertical. And, it provides such a cane system wherein such at least one handle further comprises at least one knob-end handle structured and arranged to permit gripping of the cane on a knob-end.

In accordance with another preferred embodiment hereof, this invention provides a cane system, relating to minimizing jarring shock and maximizing comfort of a user during use of a cane, comprising: at least one handle structured and arranged to permit user gripping of the cane; at least one walking-surface contactor structured and arranged to contact a walking surface; at least one height adjuster structured and arranged to adjust the height of the cane from a minimum height to a maximum height; and at least one shock absorber structured and arranged to absorb shock occurring, during use of the cane, between such at least one walking-surface contactor and such at least one handle; wherein such at least one handle comprises at least one multi-angle handle structured and arranged to permit user gripping of the cane at multiple angles.

Further, it provides such a cane system wherein such at least one multi-angle handle comprises at least one curve. Even further, it provides such a cane system wherein such at least one multi-angle handle further comprises a vertical orientation from end to end when the cane is longitudinally vertical. Even further, it provides such a cane system wherein such at least one handle further comprises at least one single-angle vertical handle structured and arranged to permit gripping of the cane at a single angle, vertical when the cane is longitudinally vertical. Even further, it provides such a cane system wherein such at least one handle further comprises at least one knob-end handle structured and arranged to permit gripping of the cane on a knob-end.

In accordance with another preferred embodiment hereof, this invention provides a cane system, relating to minimizing jarring shock and maximizing comfort of a user during use of a cane, comprising: handle means for permitting user gripping of the cane; walking-surface contactor means for contacting a walking surface; continuous height adjuster means for adjusting the height of the cane continuously from a minimum height to a maximum height; and shock absorber means for absorbing shock occurring, during use of the cane, between such at least one walking-surface contactor and such at least one handle; wherein such shock absorber means comprises force adjuster means for adjusting a compression force of such shock absorber means. Even further, it provides such a cane system wherein such handle means comprises multi-angle handle means for permitting user gripping of the cane at multiple angles. And, it provides for each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
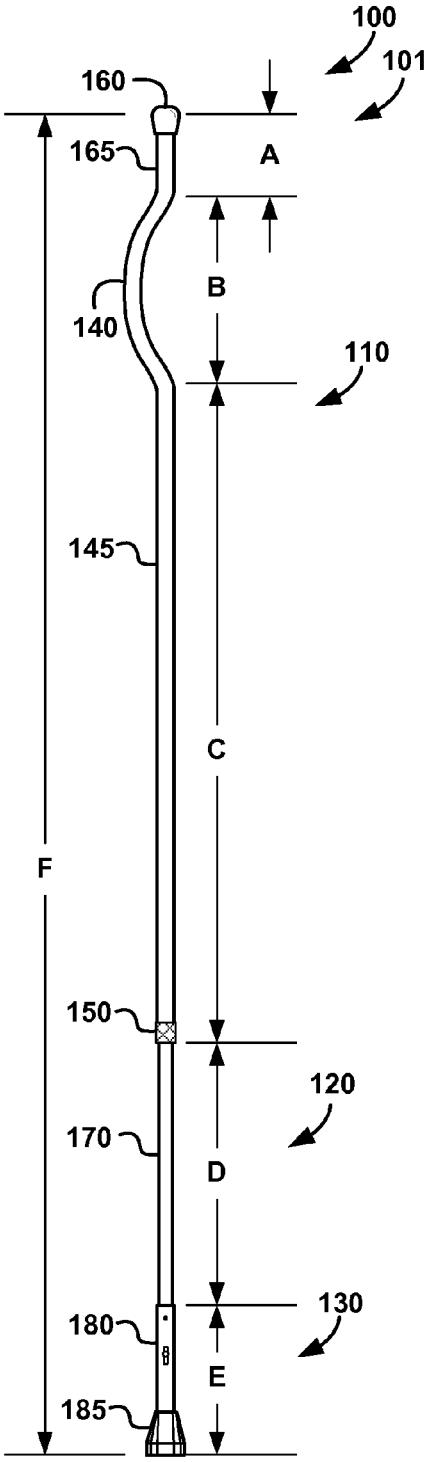
FIG. 1 shows a side view illustrating a shock absorber cane system according to a preferred embodiment of the present invention.

FIG. 1 shows a side view illustrating a shock absorber cane system 100 according to a preferred embodiment of the present invention. Shock absorber cane system 100 preferably comprises cane 101, as shown. Cane 101 preferably comprises an upper assembly 110, an extension assembly 120 and a foot assembly 130, as shown.

Upper assembly 110 preferably comprises at least one handle 140, an extension receiver 145, and at least one handle extension 165, as shown. Extension assembly 120 preferably comprises an extendable segment 170, preferably permitting adjustment in height of cane 101, as shown. Foot assembly 130 preferably comprises at least one shock absorber segment 180 and a surface-contact foot 185, as shown.

Extension receiver 145 preferably comprises a hollow, preferably a hollow tube, structured to receive extendable segment 170 to permit adjusting of height of cane 101, as shown. Extension receiver 145 and extendable segment 170 preferably assemble in a telescopic fashion, as shown (at least herein embodying wherein said at least one continuous height adjuster comprises at least two telescoping tubes). Extension receiver 145 and extendable segment 170 preferably comprise a coaxial arrangement, as shown. Extension receiver 145 further comprises at least one friction-lock nut 150 (at least herein embodying wherein said at least one continuous height adjuster further comprises at least one friction-lock nut), as shown. Friction-lock nut 150 preferably surrounds the circumference of extension receiver 145. Friction-lock nut 150 preferably tightens around the end of extension receiver 145, compressing to increase a normal force on extendable segment 170, thereby increasing the friction between extension receiver 145 and extendable segment 170 and preferably locking them in place relative to one another, as shown. This arrangement at least embodies herein at least one continuous height adjuster structured and arranged to adjust the height of the cane continuously from a minimum height to a maximum height; and this arrangement at least embodies herein at least one height adjuster structured and arranged to adjust the height of the cane from a minimum height to a maximum height; and this arrangement at least embodies herein continuous height adjuster means for adjusting the height of the cane continuously from a minimum height to a maximum height.

In use, a user will adjust the overall height of cane 101 by loosening friction-lock nut 150 and sliding extendable segment 170 in or out of extension receiver 145, as desired. Then the user will tighten friction-lock nut 150, preferably locking extendable segment 170 and extension receiver 145 in place with respect to each other. By utilizing friction-lock nut 150, as shown, cane 101 provides full and continuous height adjustment from minimum height to maximum height as opposed to stepped-height adjustment found in pin-locking systems.

Cane 101 preferably comprises an overall height F of between about 52 inches and about 82 inches, as shown. Extension receiver 145 preferably comprises a height C of about 32 inches, as shown. Handle 140 preferably comprises a height B of about nine inches, as shown. Handle extension 165 preferably comprises a height A of about four inches, as shown. Foot assembly 130 preferably comprises a height E of about 7 inches, as shown. Extendable segment 170 preferably comprises an extension height D of about 30 inches, as shown.

Overall height F of cane 101 preferably permits positioning of handle 140 at a height of about elbow height with most users. At elbow height the user will be able to grip cane 101 in a "walking stick" fashion, preferably gripping handle 140 in a more vertical manner than a traditional cane (having a primarily horizontal handle).

Surface-contact foot 185 preferably provides a non-skid contact point with a walking surface or floor, as shown. Surface-contact foot 185 preferably comprises at least one rubberized material, as shown. Surface-contact foot 185 (at least embodying herein at least one walking-surface contactor structured and arranged to contact a walking surface; and at least embodying herein walking-surface contactor means for contacting a walking surface) preferably couples with the bottom of shock absorber segment 180, as shown.

Figure 2:
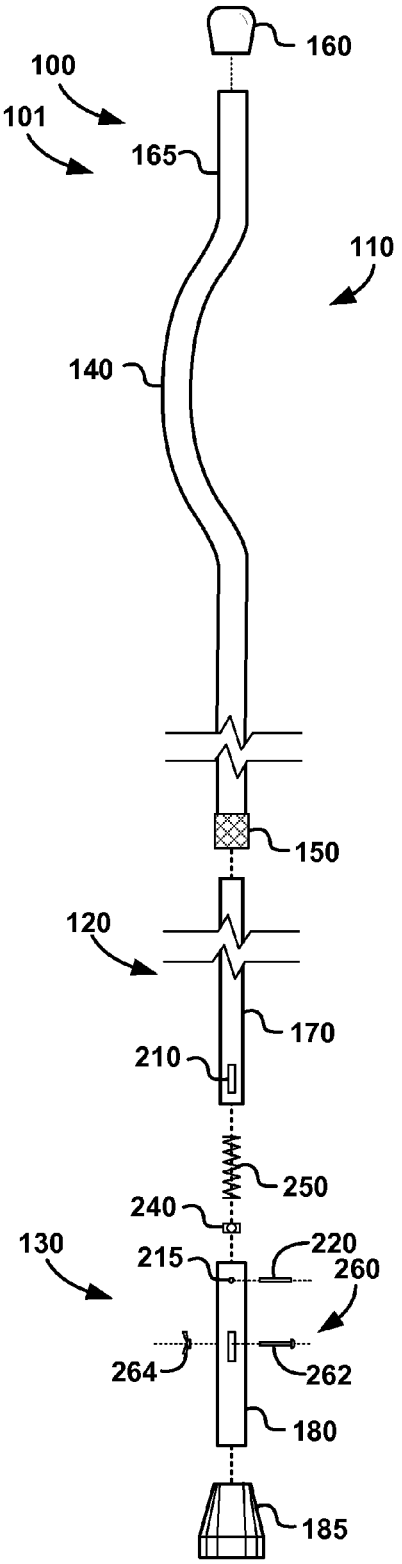
FIG. 2 shows an exploded view of the shock absorber cane system according to the preferred embodiment of FIG. 1.
Figure 3:
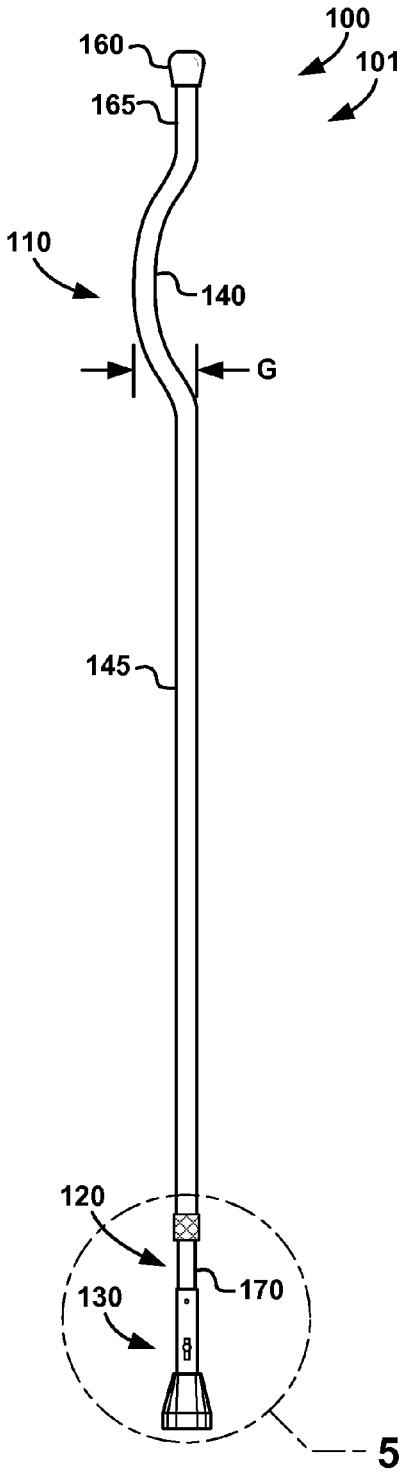
FIG. 3 shows a side view, illustrating collapsing of the height of the shock absorber cane system, according to the preferred embodiment of FIG. 2.
Figure 4:
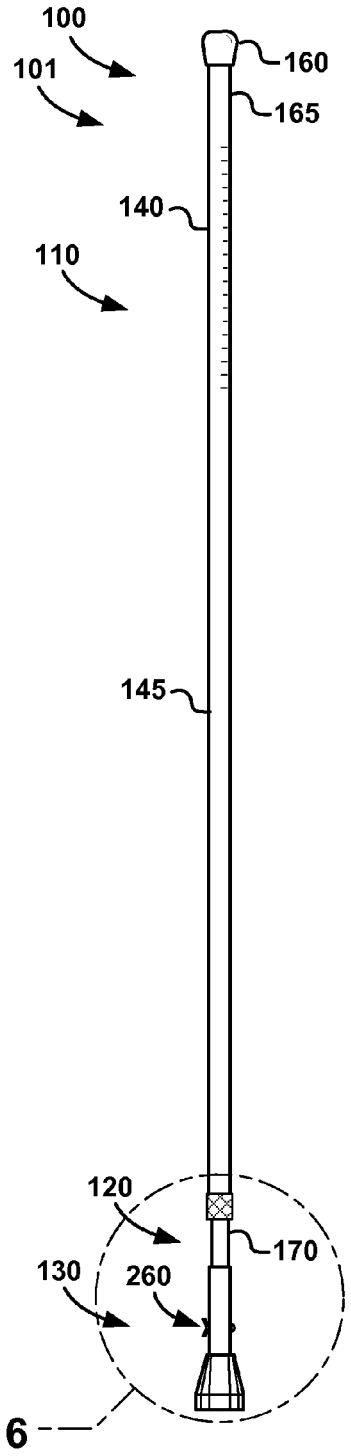
FIG. 4 shows a front view, illustrating an adjustable shock absorber, according to the preferred embodiment of FIG. 3.
Figure 5:
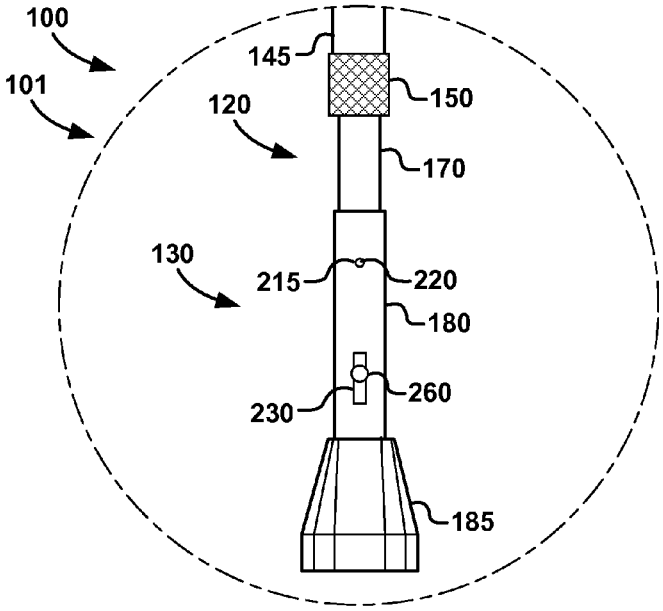
FIG. 5 shows a enlarged side view of the adjustable shock absorber according to the preferred embodiment of FIG. 3.
Figure 6:
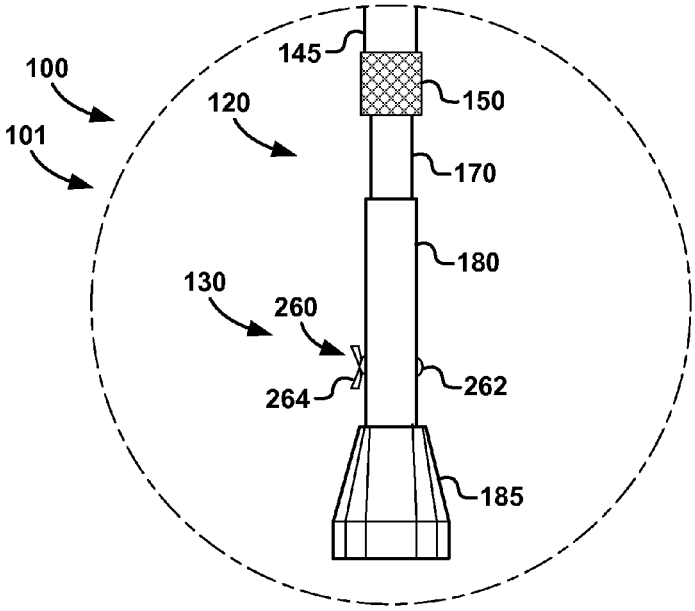
FIG. 6 shows a enlarged front view of the adjustable shock absorber according to the preferred embodiment of FIG. 4.
Figure 7:
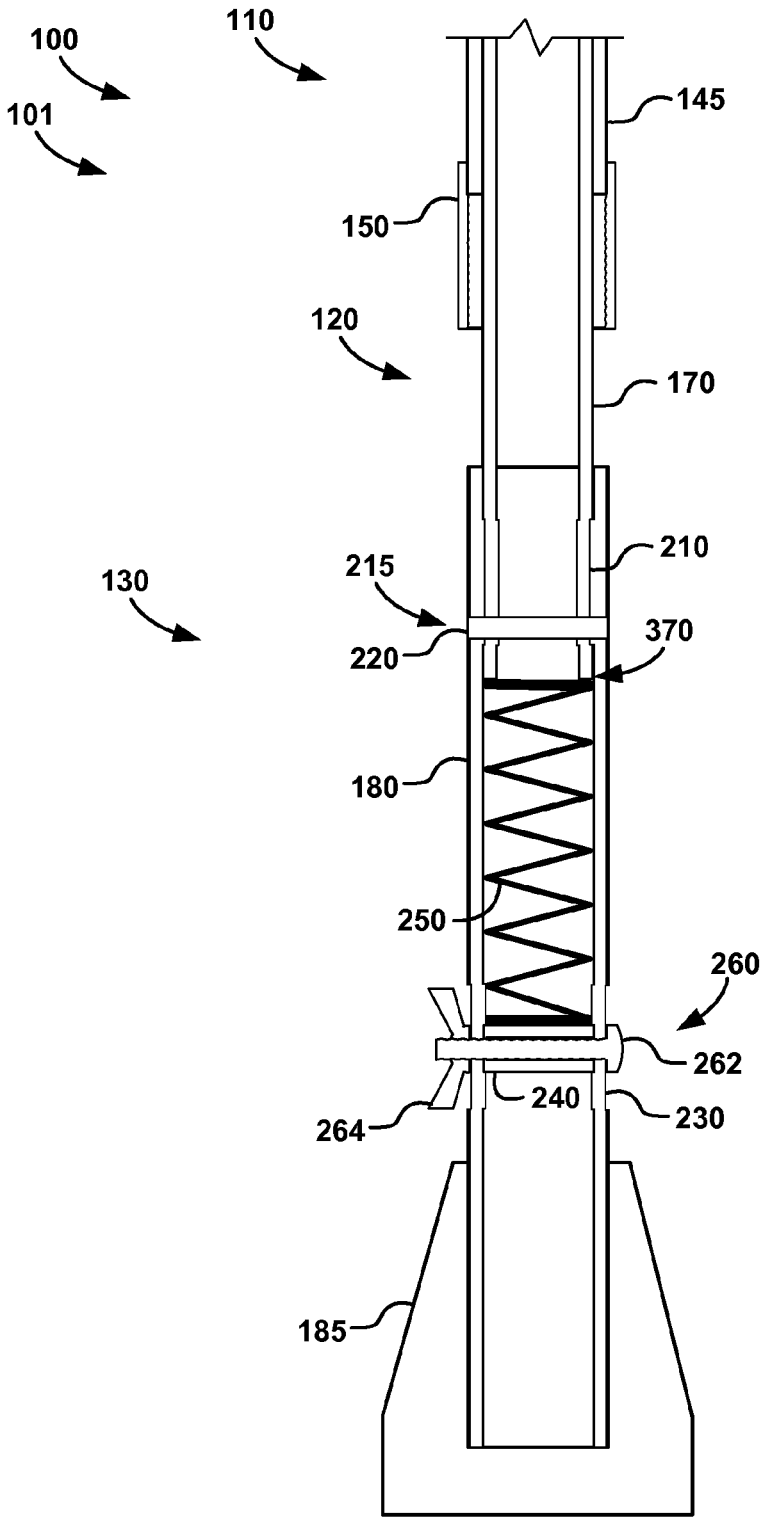
FIG. 7 shows an enlarged partial cross-sectional view of the adjustable shock absorber according to the preferred embodiment of FIG. 6.

FIG. 2 shows an exploded view of shock absorber cane system 100 according to the preferred embodiment of FIG. 1. FIG. 3 shows a side view, illustrating collapsing of the height of shock absorber cane system 100, according to the preferred embodiment of FIG. 2. FIG. 4 shows a front view, illustrating an adjustable shock absorber, according to the preferred embodiment of FIG. 3. FIG. 5 shows an enlarged side view of the adjustable shock absorber according to the preferred embodiment of FIG. 3. FIG. 6 shows an enlarged front view of the adjustable shock absorber according to the preferred embodiment of FIG. 4. FIG. 7 shows an enlarged partial cross-sectional view of the adjustable shock absorber according to the preferred embodiment of FIG. 6.

Extension segment 170 further comprises at least one shock slot 210, as shown. Shock absorber segment 180 preferably comprises at least one shock-slot pin 220, at least one adjustment slot 230 (at least herein embodying wherein said at least one force adjuster further comprises at least one adjustment limiter structured and arranged to limit adjustment distance), at least one adjustment fastener 260, at least one adjustment stop 240 and spring 250, as shown. Upper assembly 110 further comprises at least one cap 160, as shown.

Shock-slot pin 220 preferably comprises at least one friction-fit pin, as shown. Shock-slot pin 220 preferably inserts through pin-hole 215 in shock absorber segment 180 and through shock slot 210 (at least herein embodying wherein said at least one shock absorber further comprises at least one shock compression-distance limiter structured and arranged to limit change in the compression distance of said at least one compression spring between said at least one walking-surface contactor and said at least one handle; and at least herein embodying wherein said at least one shock compression-distance limiter comprises at least one slot near said at least one end of said one tube, and at least one pin structured and arranged to slide along the length of said at least one slot) in extendable segment 170 and finally through a second pin-hole 215 on the opposite side of shock absorber segment 180, as shown. This shock-slot assembly preferably allows a restricted sliding between extendable segment 170 and shock absorber segment 180 (at least herein embodying wherein said at least one shock compression-distance limiter limits the compression distance to about the length of said at least one slot; and at least embodying herein at least one shock absorber structured and arranged to absorb shock occurring, during use of the cane, between said at least one walking-surface contactor and said at least one handle; and at least embodying herein shock absorber means for absorbing shock occurring, during use of the cane, between said at least one walking-surface contactor and said at least one handle), as shown. Shock slot 210 preferably comprises a length of about one inch, as shown.

Adjustment fastener 260 preferably comprises at least one bolt 262 and at least one wing-nut 264, as shown. Upon reading the teachings of this specification, those skilled in the art will now appreciate that, under appropriate circumstances, considering such issues as cost, future technologies, etc., other adjustment fasteners, such as, for example, thumb screws, quick releases, etc., may suffice.

Adjustment fastener 260 preferably inserts through adjustment slot 230, through adjustment stop 240 (at least herein embodying wherein said at least one force adjuster comprises at least one adjustment stop structured and arranged to adjustably stop one end of said at least one compression spring) and through a second adjustment slot 230 (at least herein embodying wherein said at least one adjustment limiter comprises at least one adjustment slot, and at least one fastener rod structured and arranged to slide along the length of said at least one adjustment slot; and at least herein embodying wherein said at least one fastener rod couples with said at least one adjustment stop) on the opposite side of shock absorber segment 180, as shown. Adjustment slot 230 preferably comprises a length of about one inch, as shown. In use, adjustment fastener can be loosened and slid up or down in adjustment slot 230 thereby likewise moving adjustment stop 240 effecting a change in the distance between the bottom edge 370 of extendable segment 170 and adjustment stop 240 (see FIG. 7) (at least herein embodying wherein said at least one force adjuster comprises at least one compression adjuster structured and arranged to adjust the compression of said at least one compression spring while at minimum shock-compression; and at least herein embodying wherein said at least one shock absorber compresses said at least one compression spring between at least one end of one tube of said at least two telescoping tubes and said at least one adjustment stop). This arrangement at least embodies herein wherein said at least one shock absorber comprises at least one force adjuster structured and arranged to adjust a compression force of said at least one shock absorber; and this arrangement at least embodies herein wherein said shock absorber means comprises force adjuster means for adjusting a compression force of said shock absorber means.

Spring 250 preferably comprises at least one compression spring (at least herein embodying wherein said at least one shock absorber comprises at least one compression spring).

Spring 250 preferably inserts between bottom edge 370 of extendable segment 170 and adjustment stop 240, as shown in FIG. 7. For Illustration purposes spring 250 is left whole in the cross-sectional view of FIG. 7. Spring 250 preferably comprises a diameter substantially matching the diameter of extendable segment 170, as shown. Spring 250 preferably compresses between bottom edge 370 and adjustment stop 240, as shown. As is known, a spring's force is measured relative to the distance it is compressed, therefore as adjustment stop 240 moves closer to bottom edge 370, the spring force of spring 250 increases, as shown (at least herein embodying wherein said at least one force adjuster alters the maximum distance between said at least one end of said one tube of said at least two telescoping tubes and said at least one adjustment stop).

Handle 140 preferably comprises an arc, preferably a continuous arc, as shown (at least herein embodying wherein said at least one multi-angle handle comprises at least one curve). Handle 140 preferably comprises a width G of about 3 inches (see FIG. 3). Handle 140 preferably comprises a generally vertical orientation when cane 101 is upright, as shown (at least herein embodying wherein said at least one multi-angle handle further comprises a vertical orientation from end to end when the cane is longitudinally vertical).

Figure 8:
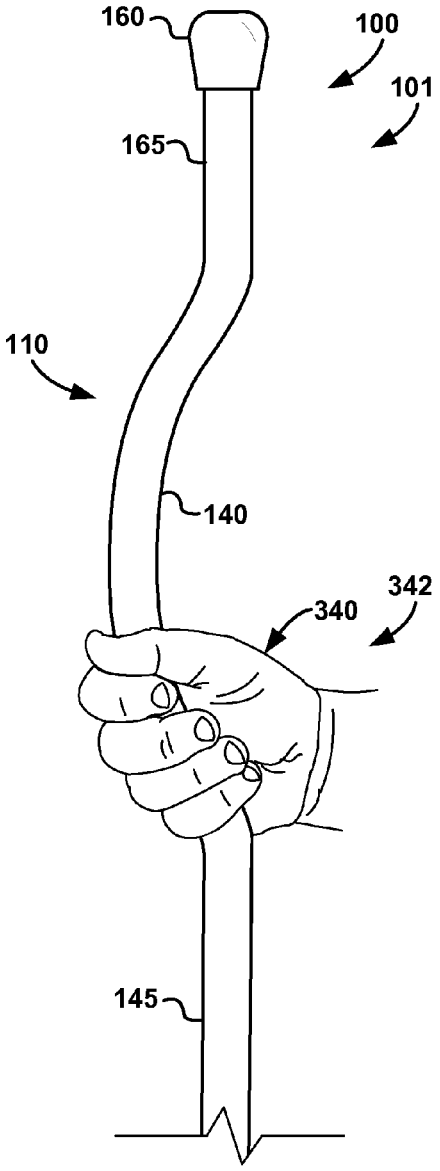
FIG. 8 shows a side view, illustrating a multi-angled handle with a forward angled hand-posture grip, according to the preferred embodiment of FIG. 1.
Figure 9:
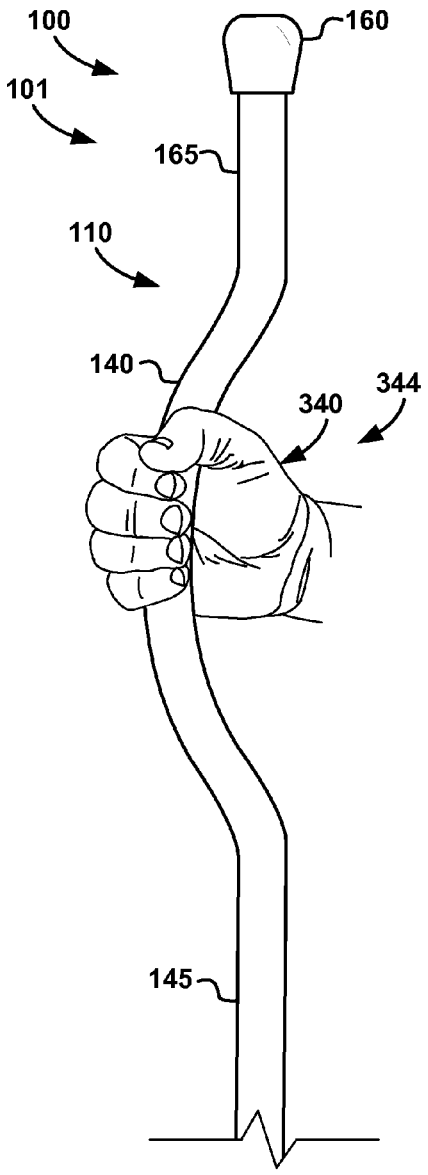
FIG. 9 shows a side view, illustrating a multi-angled handle with a vertical angled hand-posture grip, according to the preferred embodiment of FIG. 1.

FIG. 8 shows a side view, illustrating a multi-angled handle with a forward angled hand-posture grip 342, according to the preferred embodiment of FIG. 1. FIG. 9 shows a side view, illustrating a multi-angled handle with a vertical angled hand-posture grip 344, according to the preferred embodiment of FIG. 1. Handle 140 preferably comprises at least one multi-angled handle, as shown. A user's hand 340 preferably may grip handle 140 anywhere along handle 140, as shown. Due to the arc design of handle 140, when user's hand 340 changes position along the length of handle 140, the angle of the wrist shifts, as shown, from forward angled hand-posture grip 342 through vertical angled hand-posture grip 344 and into a backward angled hand-posture grip (not shown) (at least herein embodying wherein said at least one handle comprises at least one multi-angle handle structured and arranged to permit user gripping of the cane at multiple angles; and at least herein embodying wherein said handle means comprises multi-angle handle means for permitting user gripping of the cane at multiple angles). This arrangement preferably permits a change of wrist angle of between about 30 degrees and about 45 degrees. Therefore, in use, the user may adjust the height of cane 101 to best place the user's hand 340 at a position on handle 140 (at least embodying herein at least one handle structured and arranged to permit user gripping of the cane; and at least embodying herein handle means for permitting user gripping of the cane) to be at the most comfortable height and angle while still providing the support needed from cane 101.

Handle extension 165 preferably extends above handle 140. Handle extension 165 preferably extends the graspable surface available to a user beyond handle 140, preferably allowing a strong grip at the uppermost portion of handle without going off the end of cane 101. Further, handle extension 165 preferably allows a short section which is both straight and vertical should that be more comfortable to grip (at least herein embodying wherein said at least one handle further comprise at least one single-angle vertical handle structured and arranged to permit gripping of the cane at a single angle, vertical when the cane is longitudinally vertical). End of handle extension 165 preferably comprises cap 160. Cap 160 preferably comprises a rounded end, preferably comprising a firm but not hard end to grip. When in use, the user may determine that gripping cap 160 in the palm of hand 340 or with the fingers of hand 340, to place weight directly along the length of cane 101, is desirable, particularly if using cane 101 to get up from a seated position (at least herein embodying wherein said at least one handle further comprise at least one knob-end handle structured and arranged to permit gripping of the cane on a knob-end).

In effect, handle 140, handle extension 165, and cap 160 provide three distinct hand graspable points on cane 101 that have three distinct hand and wrist positionings. Each wrist positioning is available to the user at all times. Therefore, the user may elect to utilize the straight vertical, straight horizontal and the variable vertical wrist positions to grip and use cane 101.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A cane system, relating to minimizing jarring shock and maximizing comfort of a user during use of a cane, comprising:

a) at least one handle structured and arranged to permit user gripping of the cane;

b) at least one walking-surface contactor structured and arranged to contact a walking surface;

c) at least one continuous height adjuster structured and arranged to adjust the height of the cane continuously from a minimum height to a maximum height; and d) at least one shock absorber structured and arranged to absorb shock occurring, during use of the cane, between said at least one walking-surface contactor and said at least one handle;

e) wherein said at least one shock absorber comprises at least one force adjuster structured and arranged to adjust a compression force of said at least one shock absorber;

f) wherein said at least one continuous height adjuster comprises at least two telescoping tubes;

g) wherein said at least one continuous height adjuster further comprises at least one friction-lock nut;

h) wherein said at least one shock absorber comprises at least one compression spring;

i) wherein said at least one shock absorber further comprises at least one shock compression-distance limiter structured and arranged to limit change in the compression distance of said at least one compression spring between said at least one walking-surface contactor and said at least one handle;

j) wherein said at least one force adjuster comprises at least one compression adjuster structured and arranged to adjust the compression of said at least one compression spring while at minimum shock-compression;

k) wherein said at least one force adjuster further comprises at least one adjustment limiter structured and arranged to limit adjustment distance;

l) wherein said at least one force adjuster comprises at least one adjustment stop structured and arranged to adjustably stop one end of said at least one compression spring;

m) wherein said at least one shock absorber compresses said at least one compression spring between at least one end of one tube of said at least two telescoping tubes and said at least one adjustment stop;

n) wherein said at least one shock compression-distance limiter comprises i) at least one slot near said at least one end of said one tube, and ii) at least one pin structured and arranged to slide along the length of said at least one slot;

o) wherein said at least one shock compression-distance limiter limits the compression distance to about the length of said at least one slot;

p) wherein said at least one force adjuster alters the maximum distance between said at least one end of said one tube of said at least two telescoping tubes and said at least one adjustment stop;

q) wherein said at least one adjustment limiter comprises i) at least one adjustment slot, and ii) at least one fastener rod structured and arranged to slide along the length of said at least one adjustment slot;

r) wherein said at least one fastener rod couples with said at least one adjustment stop.

2. The cane system according to claim 1 wherein said at least one handle comprises at least one multi-angle handle structured and arranged to permit user gripping of the cane at multiple angles.

3. The cane system according to claim 2 wherein said at least one multi-angle handle comprises at least one curve.

4. The cane system according to claim 3 wherein said at least one multi-angle handle further comprises a vertical orientation from end to end when the cane is longitudinally vertical.

5. The cane system according to claim 2 wherein said at least one handle further comprises at least one single-angle vertical handle structured and arranged to permit gripping of the cane at a single angle, vertical when the cane is longitudinally vertical.

6. The cane system according to claim 5 wherein said at least one handle further comprises at least one knob-end handle structured and arranged to permit gripping of the cane on a knob-end.

* * * * *